United States Patent [19]

Eckert

[11] 3,984,110

[45] Oct. 5, 1976

[54] CHESS SET

[76] Inventor: Richard R. Eckert, 115 Gilbert St., Mather Air force Base, Calif. 95655

[22] Filed: Dec. 4, 1974

[21] Appl. No.: 529,562

[52] U.S. Cl. ..... 273/136 D; 273/136 R; 273/137 R; 206/499; 58/144

[51] Int. Cl.[2] ..... A63F 3/02

[58] Field of Search ..... 273/131, 136, 137, 134

[56] References Cited

UNITED STATES PATENTS

| | | | |
|---|---|---|---|
| 688,900 | 12/1901 | Toepfer | 273/136 D |
| 1,148,737 | 8/1915 | Atkins | 273/134 CA |
| 3,039,775 | 6/1962 | Mangano | 273/136 A |
| 3,517,935 | 6/1970 | Graham | 273/137 R |
| 3,568,357 | 3/1971 | Lebensfeld | 273/137 A UX |
| 3,677,550 | 7/1972 | Mathers | 273/137 R |
| 3,806,128 | 4/1974 | Endfield | 273/137 R |

FOREIGN PATENTS OR APPLICATIONS

| | | | |
|---|---|---|---|
| 281,468 | 6/1952 | Switzerland | 273/136 A |

*Primary Examiner*—Delbert B. Lowe
*Attorney, Agent, or Firm*—Blair & Brown

[57] ABSTRACT

A portable interfitting cylindrical chess set in which the pieces are made of clear and smoked transparent plastic, and are played on a board made of reflective aluminized Mylar. Included are a pair of hourglass-like chess timers for indicating the time interval spent on each move, and the pieces and timers, when assembled, form their own carrying case.

3 Claims, 6 Drawing Figures

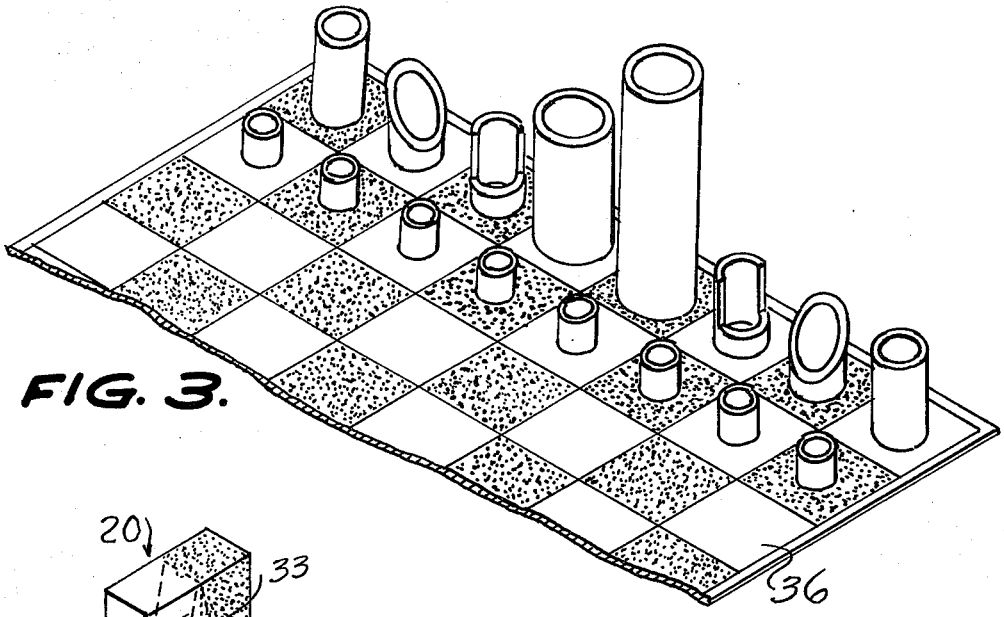
FIG. 3.
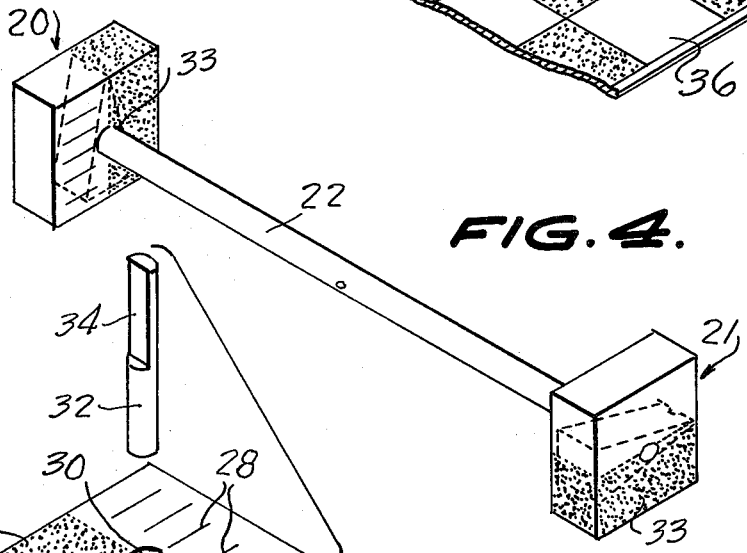
FIG. 4.
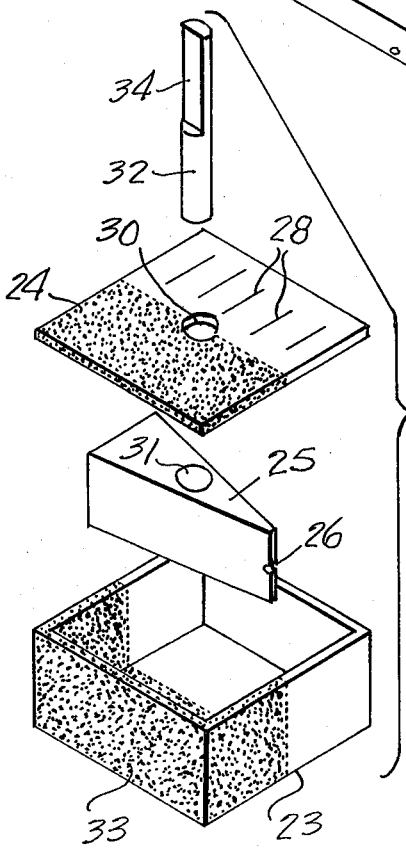
FIG. 5.
FIG. 6.
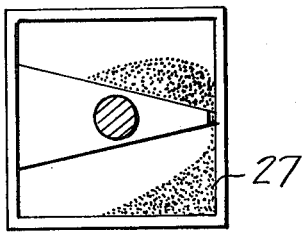

CHESS SET

BACKGROUND OF THE INVENTION

While a typical chess set tends to reflect the country of its origin with respect to the characterization of its pieces, the international stature and acceptance of the game would suggest the desirability of representing these pieces on the basis of their functions. Therefore, the present invention relates to a chess set wherein the size and configuration of its pieces indicate the type of piece involved, how the piece moves across the board, and the relative point-count associated with that particular piece. Thus, the pieces, when viewed in elevation, show the characteristic move of each, such as; the Bishop is cut diagonally, the Knight is cut in an L-shape, and the Rook has a straight cut. Additionally, the heights of the pieces reflect their relative point-count values.

The popularity of timed-move chess is catered to in the design of the hourglass-like timers which are changed after each move to thereby keep the players informed as to the time remaining from their 5-minute allotment.

When the pieces are made of clear and smoked transparent plastic, and are played on the board, which is made of reflective aluminized Mylar, they are attractively edge-lit over their top surfaces, adding eye appeal to a chess set well suited to the needs of the beginner, the enthusiast and the collector.

The primary object of the invention is to provide a new and improved chess set wherein the pieces are made of clear and smoked transparent plastic, and are of a size and configuration that make them readily recognizable by most players.

Other objects and advantages will become apparent in the following specification when considered in light of the attached drawings.

BRIEF DESCRIPTION OF THE DRAWINGS

FIG. 3 shows the pieces of one player, set up on the board, ready for a game;

FIG. 4 is a view of the timers, with means on each end of a rod for recording elapsed time of 2 player;

FIG. 5 is an exploded view showing the components making up a timer; and

FIG. 6 is an end view of a timer showing how sand flows around the end of a wedge to indicate elapsed time.

DESCRIPTION OF THE PREFERRED EMBODIMENT

Figure 1:
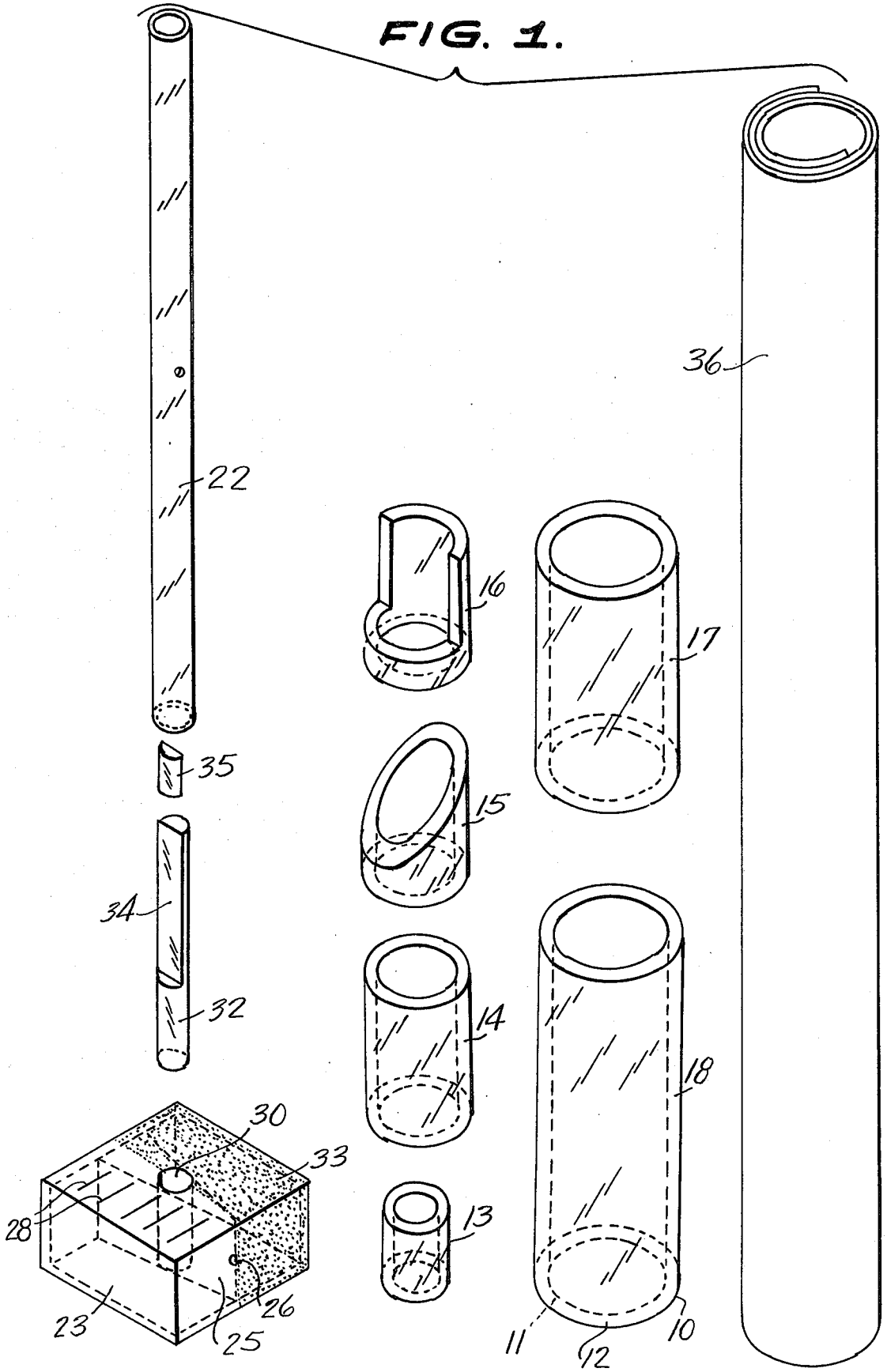
FIG. 1 is an exploded view of the complete chess set, showing a typical set of chessmen, a rolled-up playing board, and a timer.

Referring now to FIG. 1 it can be seen that the chessmen are constructed from clear, transparent, cylindrical plastic having an outer surface 10 and an inner surface 11 spaced apart to form a wall 12. The elevational height of each piece of plastic has been selected according to the point value given to the chessman the plastic is to represent. Thus, it can be seen in FIG. 1 that the shortest piece 13 is to be the Pawn. Then the next piece is Rook 14, then a Bishop 15, Knight 16, a Queen 17 and finally the King 18. It may be observed in the view of FIG. 1 that the chessmen are not shown in the precise sequence of ascending point value since the Bishop 15 and Knight 16 are of equal value, while Rook 14 is of greater value but is shown in line before them.

In order to assist a player by refreshing his memory as to the direction a chessman moves across the board, the top edge of the piece may be cut in a manner indicative of this direction. Thus, Pawns 13, Rooks 14, and Queens and Kings move in straight lines so their top edges are straight. Bishops 15 move diagonally and have a slanting top, while Knights move straight and then to the side so their tops are cut L-shaped.

Frequently it is important to record the time a player takes in planning his attack and moving his chessmen. Included with the chess set of the present invention there is a timer shown in FIGS. 4, 5 and 6, there being means for recording the time of each of the two players. In FIG. 4 there is a timer 20 for one player and 2 timer 21 for the other player, the two timers being mounted on stem 22. When the assembled timers are laid flat one timer, in the view of FIG. 4, timer 21, for example, is operating, while timer 20 is not.

As seen in FIG. 5 each timer comprises a square box 23 having a lid 24, and located inside there is a wedge-shaped member 25. Formed in the point of wedge 25 there is a small notch 26, and the length of the wedge is exactly the same as the inside measurement of box 23 so that the wedge makes a tight fit across the box, thereby forming two compartments within the box. A quantity of finely ground sand 27, FIG. 6, is placed inside the box so that it runs from the top compartment, through the notch 26, and down into the bottom compartment when the timer is operating, as at 21 in FIG. 4, and also FIG. 6. If desired, an accurately measured amount of sand may be put in the box so that it will run from the top to the bottom compartment in precisely 5 minutes, for example, indicating the total time allotted a player for a tournament. For each move the sand is allowed to run, and there are a plurality of markers 28 along the side of the top compartment to indicate the time remaining.

There is a hole 30 drilled in the center of lid 24 and also another hole 31 in the side of wedge 25, the holes being accurately aligned to receive a stub 32 when the timer is assembled and mounted on stem 22, as seen in FIG. 4. The lower compartment of square 23 has a smoked appearance, or stippling 33, to clearly distinguish between the used and unused time compartments.

The plug 32, which is inserted through hole 30 in lid 24 and hole 31 in wedge 25, has a flattened, half-round portion 34 cut along a portion of its length. A small half-round bit 35 is fastened in the end of stem 22 so that it will mate with flattened portion 34 of stub 32 when they are pressed together, thereby assuring that timer bases, or squares 20, 21, are parallel with each other and that they both extend vertically when placed on a flat surface.

The playing board 36 is made of reflective aluminized material, such as Mylar, and has 64 squares in 8 rows of 8 squares each, with alternate clear and dark squares, according to the accepted pattern of international chess. The reflective property of the board tends to reflect surrounding light up through the clear plastic chessmen, thereby giving their upper edge a lighted effect.

Figure 2:
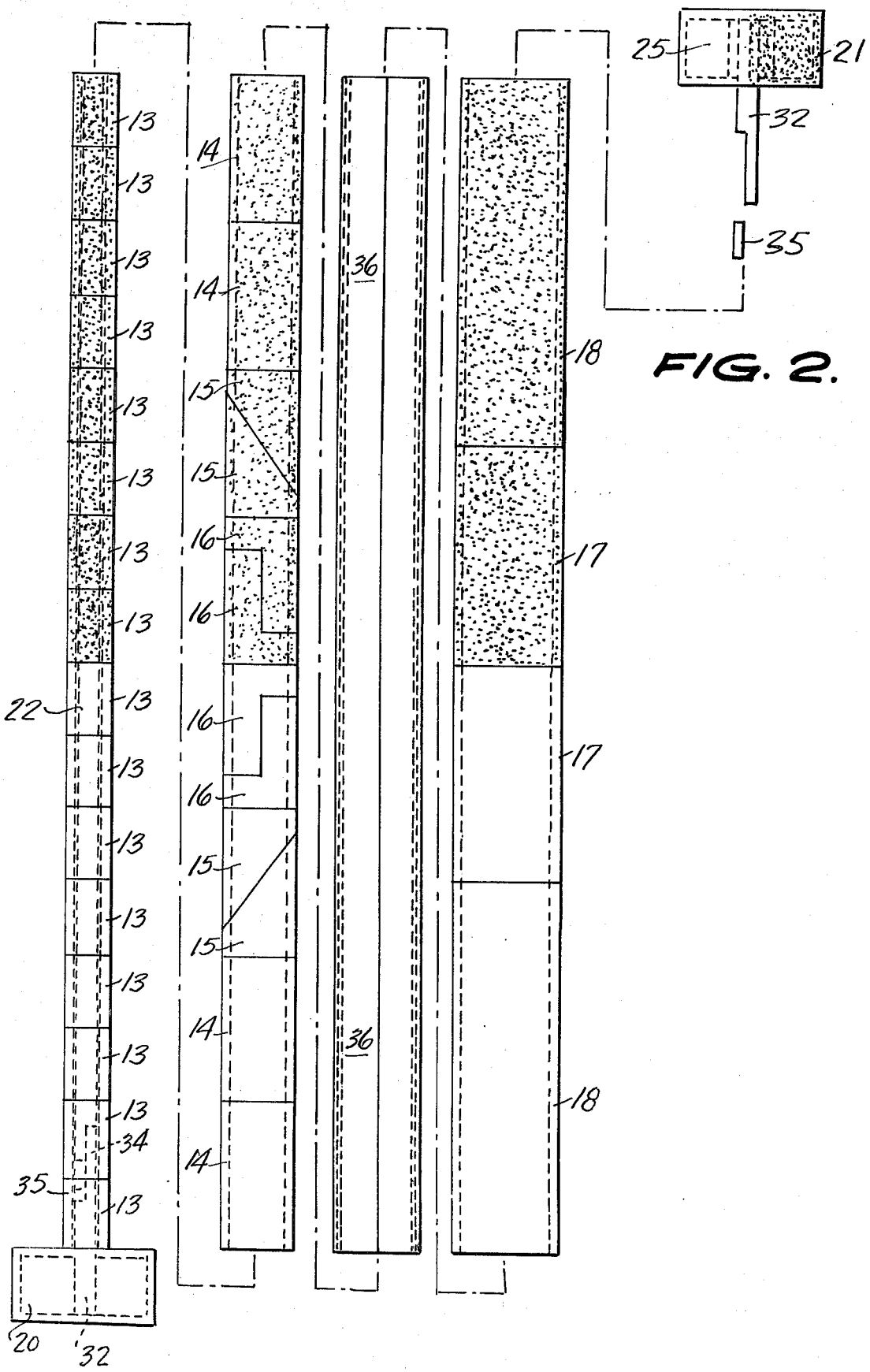
FIG. 2 shows an elongated view of how the various components are arranged when they are combined for storage or transportation.

One of the features of the present invention is that the chess set, and all of its components, may be assembled into a neat compact unit for easy carrying. The assembly procedure is illustrated in FIG. 2 where it can be seen that one of the timers 20 has its stub 32 inserted through the lid, and then, along with a half-round bit 35 this is inserted into one end of stem 22. After this all of the Pawns are threaded onto the stem 22, followed by two Rooks, two Bishops, four Knights, two more Bishops, and two more Rooks. Since the outer diameter of the Pawns is smaller than the diameter (inner) of the Rooks, Bishops, and Knights, these latter pieces fit over the Pawns, filling the stem 22. After this the board, which is flexible, is rolled up into a tube and slid onto the stem 22 around the pieces. Then the two Queens and the two Kings, which have the largest inner diameter of any of the pieces, are slid over the board. Finally the remaining timer, with its stub inserted into the remaining end of stem 22, locks the entire assembly into a handy, portable unit.

As a final comment regarding the operation of the timers, it should be remembered that after a chessman is moved the player turns over the timer, and since the wedges 25, at the ends of rod 22, are at right angles to each other, this cuts off the flow of sand through notch 26 at one end and starts the flow at the other end. In this manner the elapsed time for the moves is accounted for, and the moves continue until all of the allotted sand has been used.

From the above description of the structure and operation of the invention it is obvious that the invention presents a new, novel, and attractive form of chess set which possesses many improvements and advancements over prior sets. The chessmen are made from clear, transparent, and smoked plastic, with top edges cut at angles to indicate the direction in which the piece moves across the board, and since the board is made of reflective aluminized material the top edges also appear to be edge-lit for better vision. Also included are timers which clearly indicate elapsed time of play, as may be required for tournaments. Furthermore, since the chessmen are formed from cylindrical plastic, with varying inner diameters, they may be stacked inside of one another and threaded on a rigid stem to form a handy, compact, portable unit.

While there has been described what is at present considered to be a preferred embodiment of this invention, it will be obvious to those skilled in the art that various changes and modifications may be made therein without departing from the invention, and it is, therefore, intended to cover all such changes and modifications as fall within the true spirit and scope of the invention.

What is claimed is:

1. A portable chess game apparatus comprising a flexible playing board of reflective aluminized material, having a plurality of rows of alternating light and dark squares; a plurality of hollow cylindrical clear plastic playing pieces to be placed on the squares and progressively moved from one row of squares to another row of squares; said playing pieces having diameters such that a portion of said pieces are telescopically nestable in other portions of said pieces; the vertical height of some said pieces varying to reflect their relative point count values; said reflective aluminized material of said playing board adapted to reflect light upwardly through said clear plastic pieces so that their top edges appear to be lighted; and timing means to indicate the total playing time allotted each player including; an elongate stem; a pair of hollow square clear plastic boxes each partially filled with sand and each having a broad flat face perpendicularly secured to one of the opposite ends of said stem a wedge shaped member mounted centrally in each box and extending thereacross dividing each box into two relatively equal compartments; and a notch in the narrow edge of each of said wedge shaped members connecting the respective compartments in each of said boxes to alone permit the sand to flow from one compartment to the other to indicate a time interval, said wedges in said boxes pointing at right angles to each other so that when one box is positioned to permit sand to flow from one compartment thereof to the other the opposite box is positioned so no sand will flow therein.

2. The game of claim 1 wherein there are graduation marks on one side of the boxes to indicate the quantity of sand remaining in the box and thus the time remaining to be consumed in moving the pieces.

3. The game of claim 2 wherein one of the compartments in each of the boxes is tinted to designate the used sand and thus distinguish between time used in moving pieces, and the time remaining in the allotted time.

* * * * *